US005274872A

United States Patent [19]

Rich

[11] Patent Number: 5,274,872

[45] Date of Patent: Jan. 4, 1994

[54] HANDLE AND HANDLED IMPLEMENT

[76] Inventor: David B. Rich, R.R. No. 4, Box 125, Portland, Ind. 47371

[21] Appl. No.: 846,963

[22] Filed: Mar. 6, 1992

Related U.S. Application Data

[63] Continuation of Ser. No. 635,868, Dec. 28, 1990, abandoned.

[51] Int. Cl.[5] ..... A46B 5/02

[52] U.S. Cl. ..... 15/145; 15/143.1; 15/159.1; 15/176.3

[58] Field of Search ..... 15/145, 176.1, 176.2, 15/176.3, 176.4, 176.5, 176.6, 143.1, 159.1; 16/113, 114; 81/489; 403/296, 299, 300, 301

[56] References Cited

U.S. PATENT DOCUMENTS

| | | | |
|---|---|---|---|
| 124,865 | 3/1872 | Trego | 15/145 |
| 446,901 | 2/1891 | Thorpe | 15/145 |
| 844,130 | 2/1907 | Howard | 15/145 |
| 1,147,332 | 7/1915 | McNeill | 15/145 |
| 2,512,935 | 6/1950 | Hansen | 15/145 |
| 2,712,950 | 7/1955 | Siebert | 15/145 |
| 3,076,217 | 2/1963 | Scholl | 15/145 |
| 3,181,189 | 5/1965 | Leyden | 15/145 |
| 3,218,662 | 11/1965 | Fielder | 15/145 |
| 3,256,031 | 6/1966 | Fillweber | 15/145 |
| 3,682,516 | 8/1972 | Savage | 15/145 |
| 4,285,096 | 8/1981 | Swain | 16/114 R |
| 4,406,559 | 9/1983 | Geertsema | 15/145 |
| 4,541,139 | 9/1985 | Jones | 15/145 |
| 4,642,837 | 2/1987 | Nichols | 15/176.5 |
| 4,684,283 | 8/1987 | Lewis | 403/263 |

FOREIGN PATENT DOCUMENTS

| | | | |
|---|---|---|---|
| 2469985 | 5/1981 | France | 15/176.1 |

*Primary Examiner*—Harvey C. Hornsby
*Assistant Examiner*—Terrence R. Till
*Attorney, Agent, or Firm*—Lundy & Associates

[57] ABSTRACT

A handle for a handled implement. The handle has a stub, a yoke and a haft. The stub has a shank and a head. The stub has a longitudinal axis. The yoke is disposed on the shank. The yoke abuts the head axially. The yoke is free to rotate about the axis relative to the stub. The yoke has at least one lug disposed in spaced radial relation to the shank. The haft is elongate and engages the head. The haft is joined to the yoke in fixed rotational relation.

16 Claims, 3 Drawing Sheets

HANDLE AND HANDLED IMPLEMENT

This is a continuation of co-pending application Ser. No. 07/635,868 filed on Dec. 28, 1990 now abandoned.

BACKGROUND OF THE INVENTION

The present invention pertains to hand tools and more particularly pertains to handles and handled implements. Implements such as brooms, mops and the like have long had, as a handle, a length of threaded rod screwed into a threaded socket in the broom head or other working part. The handle is typically a length of wooden rod. The diameter is generally relatively narrow in comparison to other gripped items, such as hammer handles and bannisters, for reason of both weight and expense.

The greatest shortcoming of the threaded rod handle is that of unscrewing during use in response to impacts which cause a torque about the axis of the handle. This is an irritation for the user, who typically responds by tightening the handle with increasing amounts of force. Even if the user does not damage the threads by overtightening, which is common, the repeated cycles of loosening and tightening cause wear upon the threads. This wear is exacerbated by impacts which cause shear along planes transverse to the axis. Stresses are concentrated at the threads and further wear and damage occurs.

Eventually the socket threads or, more commonly, the handle threads fail. The handle can be replaced, but wear in the socket threads will shorten the life of the replacement handle unless its threads are oversize. None of this is a problem, if the working part wears out as fast as the handle, however, if the working part has a long useful life, then the problem is significant.

In some implements, the handle threads or socket threads or both are made of more wear resistant materials, i.e., metal, plastic, etc. An approach that has been taken in an attempt to solve this problem has been that of limiting rotation of the handle by some secondary means. At its crudest, this means driving a nail through socket and handle threads. Such use of a nail is likely to cause more damage than it prevents. Use of a screw, set back from the threads, avoids that shortcoming. The screw does however weaken the handle and increases stresses at that point in the handle. Tear out of the screw from the handle, requiring repositioning on the handle is likely. The screw also increases the time required for removal of a handle and essentially precludes removal without use of an appropriate screwdriver.

It is therefore highly desirable to provide an improved handle and handled implement.

It is also highly desirable to provide an improved handle and handled implement in which the handle is large in diameter, light in weight and reasonably priced.

It is also highly desirable to provide an improved handle and handled implement in which the handle can easily be removed.

It is also highly desirable to provide an improved handle and handled implement in which the handle does not unscrew in response to impacts.

It is also highly desirable to provide an improved handle and handled implement in which the handle is threaded on and in which stresses on the threads are reduced.

It is finally highly desirable to provide an improved handle and handled implement which meets all of the above desired features.

SUMMARY OF THE INVENTION

It is an object of the invention to provide an improved handle and handled implement.

It is another object of the invention to provide an improved handle and handled implement in which the handle is large in diameter, light in weight and reasonably priced.

It is another object of the invention to provide an improved handle and handled implement in which the handle can easily be removed.

It is another object of the invention to provide an improved handle and handled implement in which the handle does not unscrew in response to impacts.

It is another object of the invention to provide an improved handle and handled implement in which the handle is threaded on and in which stresses on the threads are reduced.

It is finally an object of the invention to provide an improved handle and handled implement which provides all of the above objects.

In the broader aspects of the invention there is provided a handle for a handled implement. The handle has a stub, a yoke and a haft. The stub has a shank and a head., The stub has a longitudinal axis. The yoke is disposed on the shank. The yoke abuts the head axially. The yoke is free to rotate about the axis relative to the stub. The yoke has at least one lug disposed in spaced radial relation to the shank. The haft is elongate and engages the head. The haft is joined to the yoke in fixed rotational relation.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
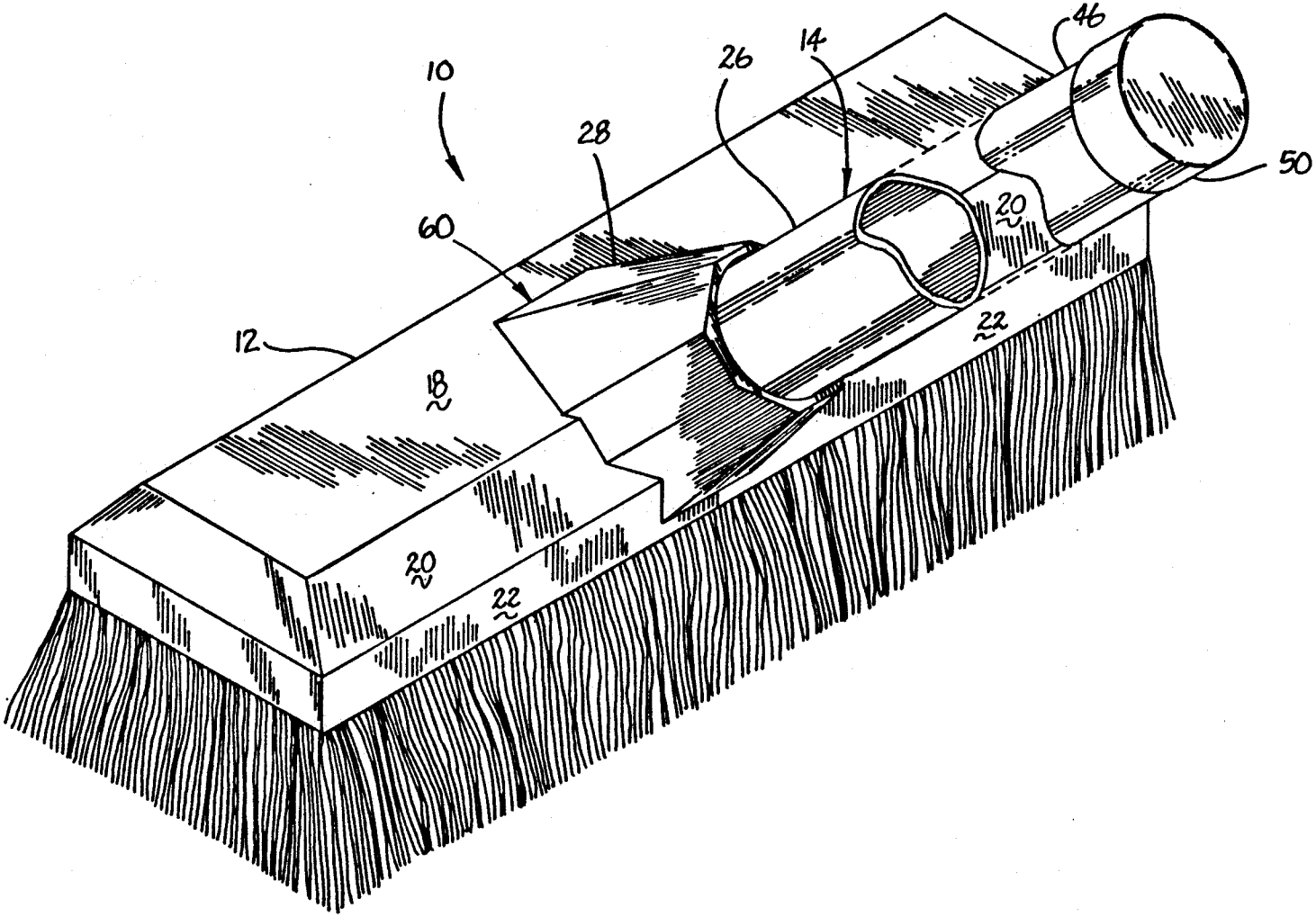
FIG. 1 is a perspective view of an embodiment of the handled implement of the invention. The working part shown is a broom head.
Figure 2:
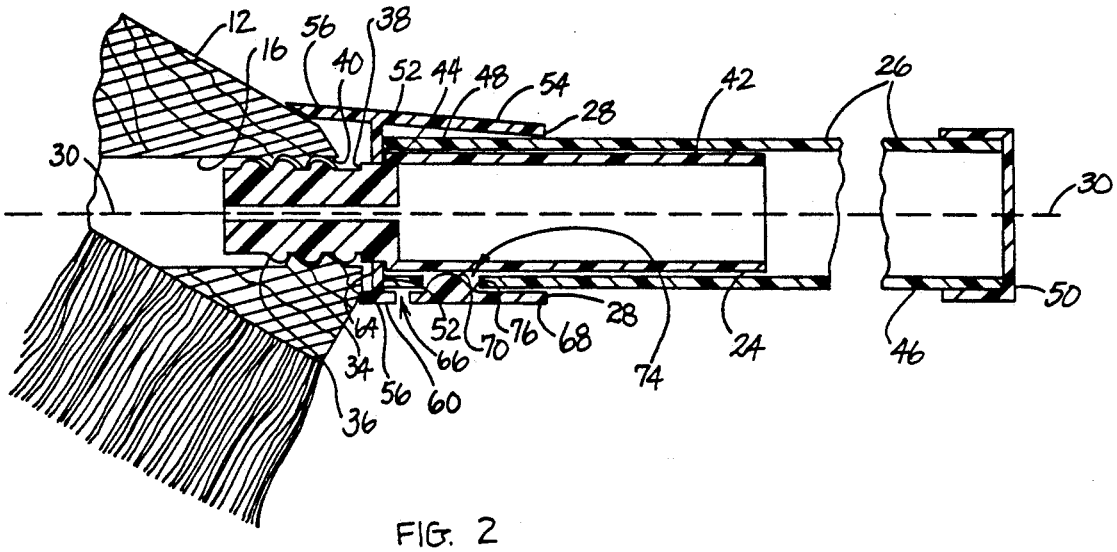
FIG. 2 is a partial cross-sectional view of the handled implement of FIG. 1 taken substantially along line 2—2.

The handled implement 10 of the invention has a working part 12, shown in the figures as a broom head, and the handle 14 of the invention. Working part 12 has a socket 16, which is angled upward when working part 12 is in a horizontal position suitable for use. Socket 16 opens onto a horizontal surface 18 and an adjoining angled surface 20. A vertical surface 22 adjoins angled surface 20. Working part 12 may have alternative socket 16 orientations and surface shapes.

Handle 14 has a stub or primary member 24, a haft or secondary member 26 and a yoke 28. Stub 24 is roughly cylindrical in shape and has a longitudinal axis 30. At the front of stub 24 is a shank or connector portion 32 that mates with socket 16. It is desirable that shank 32 and socket 16 have complementary threads 34, 36, respectively, and that shank or connector portion 32 and socket 16 are configured so as to allow shank 32 to entirely or almost entirely enter socket 16 when threads 34, 36 are fully engaged. In a particular embodiment of the invention, shank 32, behind threads 34, has an enlarged neck 38, which occupies a corresponding entrance portion 40 of socket 16, when threads 34, 36 are engaged.

Stub 24 has a head or insert portion 42 at the rear of shank 32. Head 42 is larger in diameter than shank 32 and has a forward facing, annular shoulder or stop 44. Head 42 is preferably radially symmetrical. In a particular embodiment of the invention, head 42 is generally cylindrical in shape.

Haft 26 is elongate and has an upper end 46, which is gripped by the user and a lower end 48, which encircles and is coaxial with head 42 of stub 24. Haft 26 may be straight or may bend at upper end 46 to make haft 26 easier to hold. Lower end 48 of haft 26 is complementary to head 42 and slideably engages head 42 in the manner of a piston and cylinder. In a particular embodiment of the invention, haft 26 is hollow from end 46 to end 48. In that embodiment of the invention, upper end 46 may be sealed with a cap 50.

Yoke 28 has a contact portion 52 and a casing 54. Both contact portion 52 and casing 54 are coaxial with stub 24. Contact portion 52 is roughly annular in shape and is encircled by casing 54. To the rear of contact portion 52, casing 54 is radially symmetrical and may be cylindrical or multisided. In a particular embodiment of the invention, contact portion 52 is discontinuous where it adjoins casing 54 and casing 54 has internal recesses (not shown) to reduce weight.

Casing 54 has one or more lugs 56, which render the exterior of casing 54 non-circular and engage working part 12, preferably at a complementary engagement portion 58, and prevent rotation. Lugs 56 are spaced apart from axis 30. A jaw 60 is defined by opposed, differently sized lugs 56 and a pair of opposed flats 62, interposed between lugs 56. Flats 62 are located transversely and are recessed relative to lugs 56. Jaw 60 is in substantially continuous contact with complementary engagement portion 58 of working part 12. Contact portion 52 is inset from lugs 56 and flats of jaw 60 to reduce the effect of irregularities in working part 12. In a particular embodiment of the invention, the exterior shape of casing 54 may be that of an incised octagonal prism.

Contact portion 52 loosely encircles shank 32 and yoke 28 and stub 24 can rotate freely relative to each other about axis 30. In a particular embodiment of the invention, contact portion 52 encircles stub 24 at neck 38 and a two part stop or nub 64 extends out from neck 38 in front of shoulder 44 and retains yoke 28 on neck 38. The separation of stop 64 and shoulder 44 is larger than the axial dimension of contact portion 52 so as to not interfere with relative rotation of yoke 28 and stub 24.

Contact portion 52 bears on shoulder 44 of stub 24 in a direction parallel to axis 30 and bears on or closely adjoins lower end 48 of haft 26 in the same direction. Casing 54 is reversibly joined to haft 26 such that relative rotation and relative axial movement of haft 26 and yoke 28 are precluded. In a particular embodiment of the invention, casing 54 loosely grips haft 26 and, in addition, haft 26 is releasably keyed to yoke 28. In that embodiment, yoke 28 is unitary and has a slot 66, a resilient, forward facing tongue 68 disposed within slot 66, and a spline 70 extending radially inward from tongue 68. Spline 70 has an edge 72, which is sloped to the rear and radially disposed to the front. Haft 26 has a keyway 74, which receives spline 70, keying haft 26 to yoke 28.

In order to insure easy centering of spline 70 and keyway 74, haft 26 has a pair of opposed notches 76 extending axially rearward from lower end 48 and yoke 28 has a pair of internal tabs 78 which engage notches 76. Spline 70 and keyway 74 and notches 76 and tabs 78 maintain haft 26 on head 42 and within casing 54. Minimum clearances between casing 54 and haft 26, and haft 26 and head 42 are sufficient to prevent a tight frictional fit. Maximum clearances are limited by esthetics and the possibility of spline 70 popping out of keyway 74.

Figure 3:
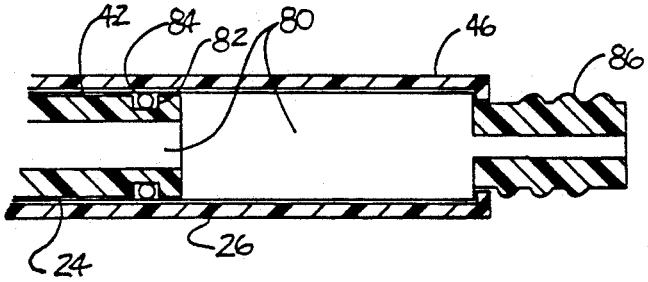
FIG. 3 is a partial cross-sectional view of an alternative embodiment of the handled implement of FIG. 1.
Figure 4:
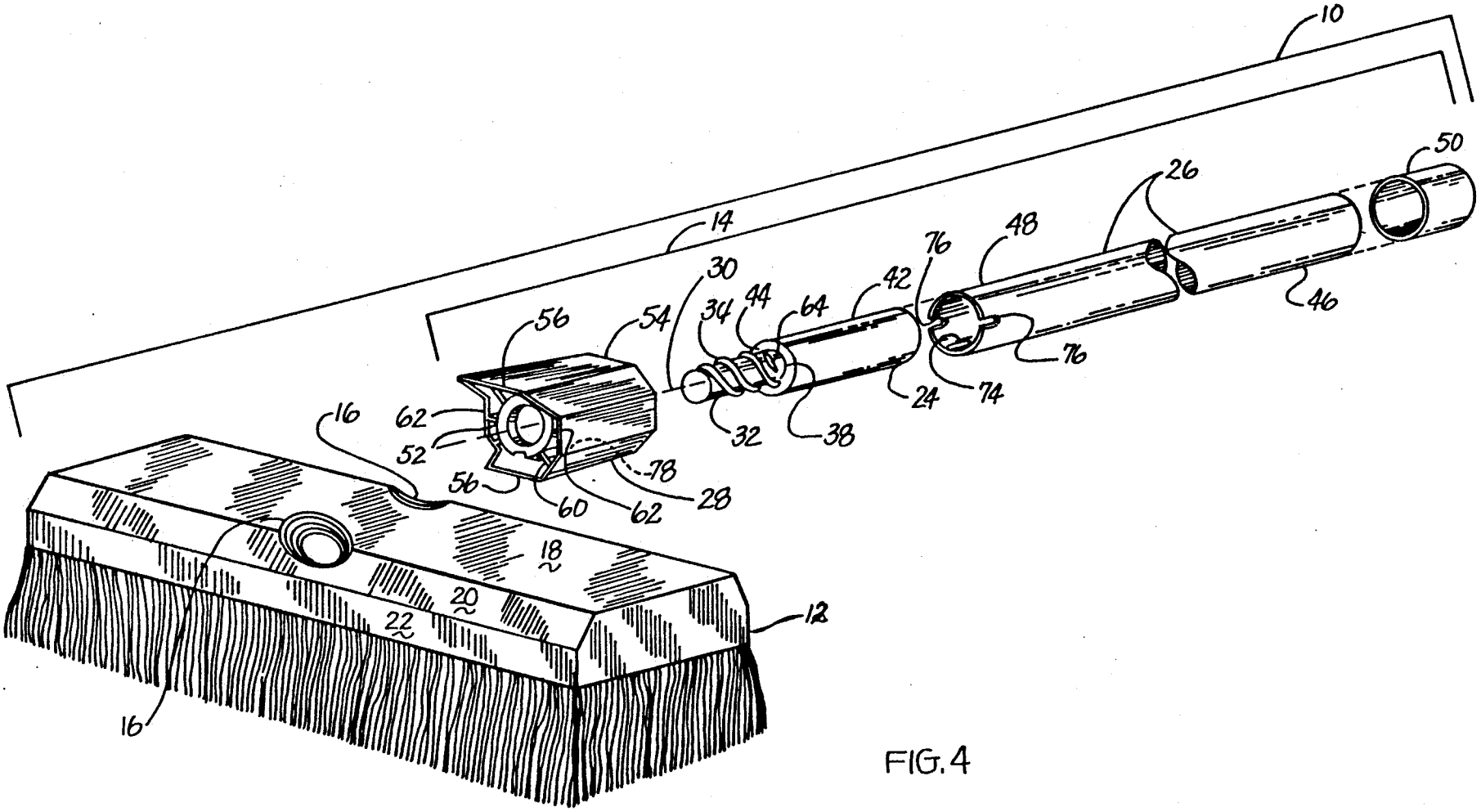
FIG. 4 is an exploded view of the handled implement of FIG. 1.

In an alternative embodiment of the invention shown in FIG. 3, stub 24 and haft 26 each have longitudinal passages 80 and head 42 of stub 24 has a circumferential O-ring groove 82, which contains an O-ring 84. In that embodiment, haft 26 engages stub 24 in substantially watertight relation and fluid admitted to haft 26 is channeled through longitudinal passages 80. Upper end 46 of haft 26 is modified to provide a hose connection 86 for a hose or the like.

In use, handle 14 and working part 12 are joined together. Haft 26 is first removed from yoke 28. In the particular embodiment of the invention discussed above, this may be done by prying tongue 68 and spline 70 outward with a fingernail or simple tool such as a door key or ball point pen. While prying, haft 26 is pulled rearward. Yoke 28 is then held in one hand and oriented correctly relative to engagement portion 58, while stub 24 is placed in socket 16 and rotated until fully engaged. At that point, lug or lugs 56 engage working part 12 and prevent relative rotation of yoke 28 and working part 12. Jaw 60 is in substantially continuous contact with working part 12. Haft 26 and yoke 28 are then reassembled by first aligning yoke 28 and haft 26 and then pushing haft 26 forward relative to yoke 28. Handled implement 10 is then used. Yoke 28 prevents working part 12 from turning relative to handle 14 during use. Yoke 28 also distributes the force of impacts or torques, which are tangential or transverse to axis 30, so as to protect threads 34, 36.

During use of working part 12, if any of the haft 26, yoke 28 or stub 24 breaks or is otherwise damaged, the haft 26, yoke 28 and stub 24 can be disassembled by reversing the procedure above described, the broken or damaged element replaced, and the handled implement of the invention reassembled.

The invention provides an improved handle and handled implement which is more durable and easily removable and easily replaceable when necessary. The improved handle can be attached to a great number of working parts 12 and will not come loose unintentionally.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. An implement handle comprising an elongated stub having a shank and a head, said stub having a longitudinal axis, said stub being adapted to be removable secured to an implement, a yoke disposed on said shank, said head having a larger dimension transverse of said axis than said shank, said head having a transverse surface between said shank and said head overlooking said shank, said yoke abutting said transverse surface to grip said yoke between said implement and said head when said stub is secured to said implement, said yoke being free to rotate about said axis relative to said stub when said stub is not secured to said implement, said yoke having at least one implement engaging lug spaced radially from said shank, said stub and yoke being fixed in relation to said implement when said stub is secured to said implement and said yoke lug engages said implement, said yoke lug engaging said implement and preventing rotary movement of said implement in relation to said yoke and stub about said axis, and an elongated haft engaging said head in sliding relation and being removably secured to said yoke in a fixed axial and rotational relation.

2. The implement handle of claim 1 wherein said haft is releasably keyed to said yoke.

3. The implement handle of claim 1 wherein said shaft has threads and said implement has a socket therein with complementary threads, whereby said stub can be removably secured to said implement.

4. The implement handle of claim 1 wherein said yoke is unitary and has a slot, a resilient tongue disposed within said slot, and a spline extending radially inwardly from said tongue, and said haft has a keyway receiving said spline and keying said haft to said yoke.

5. The implement handle of claim 1 wherein said yoke has a pair of opposed lugs disposed in spaced radial relation to said shank.

6. The implement of claim 1 wherein said yoke is in substantially continuous contact with said working part, whereby said yoke distributes torques of said working part about said axis and transverse to said axis from said working part to said stub and yoke.

7. An implement comprising a working part and a handle, said handle including a stub having a shank and a head, said shank and said working part having complementary threads to removably secure said working part to said stub, said stub having a longitudinal axis, a yoke disposed on said shank, said yoke abutting said head axially and held against said working part between said working part and said head, said yoke including means for arresting rotation of said working part about said axis in relation to said yoke and stub, and a haft slidably engaging said head, said haft being removably secured to said yoke in a fixed rotational and axial relation.

8. The implement handle of claim 7 wherein said working part has an engagement portion, and said means for arresting rotation of said working part is a jaw of said yoke on said yoke complementary to said engagement portion, said engagement portion and said jaw being in a fixed relational engagement.

9. The implement of claim 8 wherein said jaw is in substantially continuous contact with said working part, whereby said yoke distributes torques of said working part about said axis and transverse to said axis from said working part to said stub and yoke and haft.

10. The implement of claim 8 wherein said yoke has a contact portion and a casing, said casing encircling said contact portion, said contact portion encircling said shank, said yoke being freely rotatable relative to said stub, said contact portion bearing on said head, said casing including said jaw, said casing including means for retaining said haft and said yoke in fixed rotational relation.

11. The implement of claim 7 wherein said yoke is unitary and has a slot, a resilient tongue is disposed within said slot, a spline extends radially inwardly from said tongue, and said haft has a keyway receiving said spline and keying said haft to said yoke.

12. The implement of claim 7 wherein said yoke has a pair of opposed lugs disposed in spaced radial relation to said shank, said lugs being complementary to said working part.

13. A handle for attachment to a working part comprising a primary member having a longitudinal axis, said primary member having a connector portion and an insert portion and a transition portion therebetween, said transition portion including a transverse surface between said connector and insert portions having a larger dimension transverse of said axis than said connector portion, said connector portion being adapted to be removably secured to said working part, a secondary member encircling said insert portion of said primary member, said secondary member being coaxial with said primary member, a yoke having a contact portion and a casing, said casing encircling said insert portion and said secondary member, said contact portion encircling said connector portion of said primary member, said yoke being freely rotatable relative to said primary member when said connector portion is not secured to said working part, said contact portion bearing on said transverse surface of said primary member and said yoke being gripped and held secure between said working part and said transverse surface when said connector portion is secured to said working part, said contact portion including means for gripping said working part and preventing rotation of said working part about said axis relative to said primary and secondary members, said casing including means for retaining said secondary member and said yoke in fixed axial and rotational relation.

14. The implement of claim 13 wherein said retaining means is a unitary yoke having a slot, a resilient tongue is disposed within said slot, a spline extends radially inwardly from said tongue, and said secondary member has a keyway receiving said spline and keying said secondary member to said yoke.

15. The implement of claim 13 wherein said yoke has a pair of opposed lugs disposed in spaced radial relation to said shank, said lugs being complementary to said working part.

16. The implement of claim 13 wherein said yoke is in substantially continuous contact with said working part, whereby said yoke distributes torques of said working part about said axis and transverse to said axis from said working part to said stub and yoke.

* * * * *